US010876370B2

(12) United States Patent
Tibbs et al.

(10) Patent No.: US 10,876,370 B2
(45) Date of Patent: Dec. 29, 2020

(54) FRAC SYSTEM WITH FLAPPER VALVE

(71) Applicant: Cameron International Corporation, Houston, TX (US)

(72) Inventors: Cody Tibbs, Houston, TX (US); Jana Byrne, Houston, TX (US); Justin Clifton, Houston, TX (US)

(73) Assignee: Cameron International Corporation, Houston, TX (US)

( * ) Notice: Subject to any disclaimer, the term of this patent is extended or adjusted under 35 U.S.C. 154(b) by 141 days.

(21) Appl. No.: 16/130,884

(22) Filed: Sep. 13, 2018

(65) Prior Publication Data

US 2020/0088004 A1 Mar. 19, 2020

(51) Int. Cl.

| | |
|---|---|
| ***E21B 33/068*** | (2006.01) |
| ***E21B 43/26*** | (2006.01) |
| ***E21B 34/02*** | (2006.01) |

(52) U.S. Cl.

CPC ..... *E21B 33/068* (2013.01); *E21B 34/02* (2013.01); *E21B 43/26* (2013.01); *E21B 2200/05* (2020.05)

(58) Field of Classification Search

CPC .... E21B 33/03; E21B 33/0355; E21B 33/068; E21B 43/26; E21B 2034/005; E21B 34/02; E21B 34/14; E21B 34/102

See application file for complete search history.

(56) References Cited

U.S. PATENT DOCUMENTS

| | | | | |
|---|---|---|---|---|
| 6,957,703 | B2 * | 10/2005 | Trott | E21B 34/10 166/332.8 |
| 2006/0254822 | A1 | 11/2006 | Ayling | |
| 2012/0037373 | A1 | 2/2012 | Xu | |
| 2012/0152564 | A1 * | 6/2012 | Peltier | E21B 34/02 166/373 |
| 2014/0182943 | A1 | 7/2014 | Iblings | |
| 2015/0136383 | A1 * | 5/2015 | Guidry | E21B 34/02 166/85.1 |
| 2017/0175488 | A1 | 6/2017 | Lisowski et al. | |

OTHER PUBLICATIONS

PCT International Search Report and Written Opinion; Application No. PCT/US2019/050108; dated Dec. 24, 2019; 11 pages.

* cited by examiner

*Primary Examiner* — David Carroll
(74) *Attorney, Agent, or Firm* — Fletcher Yoder, P.C.

(57) ABSTRACT

A frac system including a frac tree. The frac tree includes a frac head. The frac head defines a first inlet, a second inlet, and an outlet. The frac head receives frac fluid through the first inlet and directs the frac fluid to the outlet fluidly coupled to a wellhead. A valve couples to the second inlet of the frac head. A flapper valve is within the frac head. The flapper valve moves between an open position and a closed position to control fluid flow to the valve through the second inlet. The flapper valve aligns with a first axis of the outlet and the second inlet in the closed position and aligns with a second axis of the first inlet in the open position.

18 Claims, 5 Drawing Sheets

FRAC SYSTEM WITH FLAPPER VALVE

FIELD OF THE INVENTION

The present disclosure relates generally to frac systems.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are frequently used to extract resources, such as oil and gas, from subterranean reserves. These resources, however, can be difficult to extract because they may flow relatively slowly to the well bore. Frequently, a substantial portion of the resources is separated from the well by bodies of rock and other solid materials. These solid formations impede fluid flow to the well and tend to reduce the well's rate of production.

In order to release more oil and gas from the formation, the well may be hydraulically fractured. Hydraulic fracturing involves pumping a frac fluid that contains a combination of water, chemicals, and proppant (e.g., sand, ceramics) into a well at high pressures. The high pressures of the fluid increases crack size and crack propagation through the rock formation, which releases more oil and gas, while the proppant prevents the cracks from closing once the fluid is depressurized. Unfortunately, the high-pressures and abrasive nature of the frac fluid may wear components.

BRIEF DESCRIPTION

In one embodiment, a frac system includes a frac tree. The frac tree includes a frac head. The frac head defines a first inlet, a second inlet, and an outlet. The frac head receives frac fluid through the first inlet and directs the frac fluid to the outlet fluidly coupled to a wellhead. A valve couples to the second inlet of the frac head. A flapper valve is within the frac head. The flapper valve moves between an open position and a closed position to control fluid flow to the valve through the second inlet. The flapper valve aligns with a first axis of the outlet and the second inlet in the closed position and aligns with a second axis of the first inlet in the open position.

In another embodiment, a system that includes a frac head. The frac head defines a first inlet, a second inlet, and an outlet. The frac head receives frac fluid through the first inlet and directs the frac fluid to the outlet fluidly coupled to a wellhead. A flapper valve is within the frac head. The flapper valve moves between an open position and a closed position to open and close the second inlet to control fluid flow to a valve. An actuator couples to the frac head and actuates the flapper valve. A stem couples the flapper valve to the actuator. The stem moves axially within a stem aperture in the frac head to open and close the flapper valve.

In another embodiment, a frac system that includes a flapper valve system. The flapper valve system includes a frac head. The frac head defines a first inlet, a second inlet, and an outlet. The frac head receives frac fluid through the first inlet and directs the frac fluid to the outlet fluidly coupled to a wellhead. A flapper valve is within the frac head. The flapper valve moves between an open position and a closed position to control fluid flow through the second inlet. The flapper valve aligns with a first axis of the outlet and the second inlet in the closed position and aligns with a second axis of the first inlet in the open position. An actuator couples to the frac head. The actuator opens and closes the flapper valve. A valve couples to the frac head. The flapper valve controls a flow of fluid to the valve. A controller couples to the actuator. The controller controls the actuator to close the flapper valve in response to a flow of pressurized frac fluid flowing through the first inlet.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

The present embodiments disclose a flapper valve system that in combination with another valve provide a dual barrier that controls fluid flow from a frac head. In addition to forming part of a dual barrier, the flapper valve system may protect the other valve from the pressurized frac fluid flowing through the frac head. As frac fluid is pumped into the frac head it may flow at high velocities with abrasive materials, which can wear components. By blocking or reducing contact between the frac fluid and the valve, the flapper valve system may extend the life of the other valve and/or reduce maintenance on the other valve. In some embodiments, the flapper valve system may place the flapper valve within the frac head. This position may reduce the overall height of the frac tree because a single valve (e.g., gate valve) couples to the frac head between the frac head and additional components, such as a lubricator.

Figure 1:
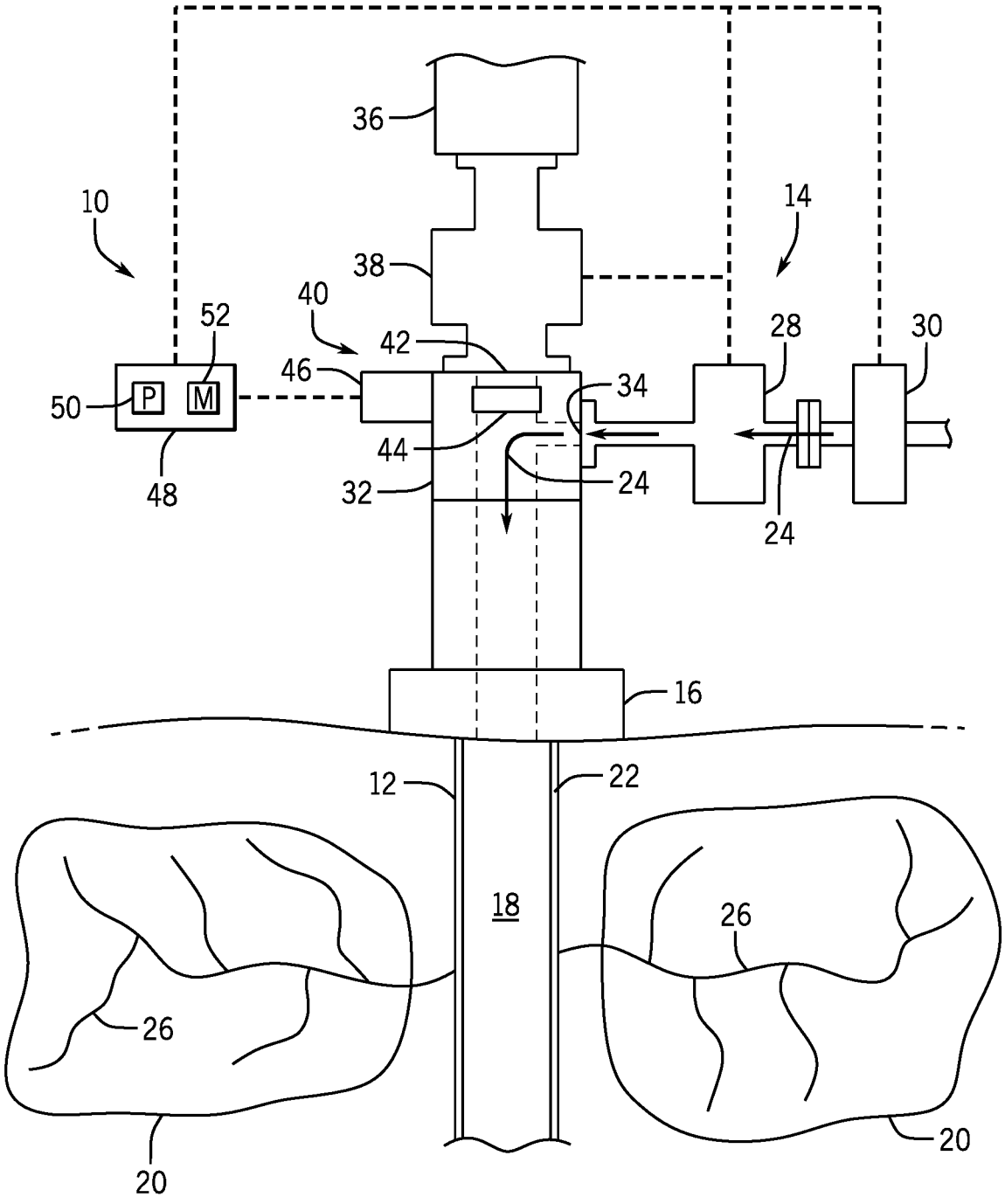
FIG. 1 is a block diagram of an embodiment of a hydrocarbon extraction system.

FIG. 1 is a block diagram that illustrates an embodiment of a hydrocarbon extraction system 10 capable of hydraulically fracturing a well 12 to extract various minerals and natural resources (e.g., oil and/or natural gas). The system 10 includes a frac tree 14 coupled to the well 12 via a wellhead hub 16. The wellhead hub 16 generally includes a large diameter hub disposed at the termination of a well bore 18 and is designed to connect the frac tree 14 to the well 12. The frac tree 14 may include multiple components that enable and control fluid flow into and out of the well 12. For example, the frac tree 14 may route oil and natural gas from the well 12, regulate pressure in the well 12, and inject chemicals into the well 12.

The well 12 may have multiple formations 20 at different locations. In order to access each of these formations (e.g., hydraulically fracture), the hydrocarbon extraction system may use a downhole tool coupled to a tubing (e.g., coiled tubing, conveyance tubing). In operation, the tubing pushes and pulls the downhole tool through the well 12 to align the downhole tool with each of the formations 20. Once the tool is in position, the tool prepares the formation to be hydraulically fractured by plugging the well 12 and boring through the casing 22. For example, the tubing may carry a pressurized cutting fluid that exits the downhole tool through cutting ports. After boring through the casing, the hydrocarbon extraction system 10 pumps frac fluid 24 (e.g., a combination of water, proppant, and chemicals) into the well 12.

As the frac fluid 24 pressurizes the well 12, the frac fluid 24 fractures the formations 20 releasing oil and/or natural gas by propagating and increasing the size of cracks 26. Once the formation 20 is hydraulically fractured, the hydrocarbon extraction system 10 depressurizes the well 12 by reducing the pressure of the frac fluid 24 and/or releasing frac fluid 24 through valves (e.g., wing valves).

The frac tree 14 includes valves 28 and 30 that couple to a frac head or housing 32 at a first inlet 34. These valves 28 and 30 fluidly couple to pumps that pressurize and drive the frac fluid into the well 12. By including the valves 28 and 30 to control the flow of frac fluid, the frac tree 14 provides redundant fluid flow control into the well 12. For example, in the event that either valve 28 or valve 30 is unable to block fluid flow the other valve is used to block fluid flow. In some embodiments, the valves 28 and 30 may be gate valves.

To facilitate insertion of tools into the well 12, the fracturing tree 14 may include a lubricator 36 coupled to the frac head or housing 32. The lubricator 36 is an assembly with a conduit that enables tools to be inserted into the well 12. These tools may include logging tools, perforating guns, among others. For example, a perforating gun may be placed in the lubricator 36 for insertion in the well 12. After performing downhole operations (e.g., perforating the casing), the tool is withdrawn back into the lubricator 36 with a wireline. In order to block the flow of frac fluid into the lubricator 36 while fracing the well 12, the frac tree 14 includes a valve 38 and a flapper valve system 40. In some embodiments, the valve 38 may be a gate valve. The combination of the valve 38 and the flapper valve system 40 provide redundant sealing to block the flow of fluid through the second inlet 42 (e.g., dual barrier system). By including a flapper valve system 40 instead of another gate valve stacked on top of the frac head or housing 32, the overall height of the frac tree 14 may be reduced, which may facilitate assembly of the frac tree 14.

As illustrated, the flapper valve system 40 is between the valve 38 and the frac head 32. In this position, the flapper valve system 40 is exposed to the frac fluid (e.g., pressurized and abrasive fluid) as the frac fluid flows into and through the frac head 32. In other words, the flapper valve system 40 may reduce or block exposure of the valve 38 to the frac fluid. By reducing the exposure of the valve 38 to the frac fluid, the operating life of the valve 38 may be extended and/or maintenance of the valve 38 may be reduced.

The flapper valve system 40 includes a flapper valve 44 and an actuator 46 that opens and closes the flapper valve 44. The actuator 46 is controlled with a controller 48. The controller 48 includes a processor 50 and a memory 52. For example, the processor 50 may be a microprocessor that executes software to control the various actuators that control the valves 28, 30, 38 as well as the actuator 46. The processor 50 may include multiple microprocessors, one or more "general-purpose" microprocessors, one or more special-purpose microprocessors, and/or one or more application specific integrated circuits (ASICs), field-programmable gate arrays (FPGAs), or some combination thereof. For example, the processor 50 may include one or more reduced instruction set (RISC) processors.

The memory 52 may include a volatile memory, such as random access memory (RAM), and/or a nonvolatile memory, such as read-only memory (ROM). The memory 52 may store a variety of information and may be used for various purposes. For example, the memory 52 may store processor executable instructions, such as firmware or software, for the processor 50 to execute. The memory may include ROM, flash memory, a hard drive, or any other suitable optical, magnetic, or solid-state storage medium, or a combination thereof. The memory may store data, instructions, and any other suitable data. In operation, the processor 50 executes instructions on the memory 52 to control the actuator 46 to open and close the flapper valve 44.

As will be explained below, the flapper valve 44 may be placed within the frac head 32. Placement of the flapper valve 44 within the frac head 32 may reduce the overall height of the frac tree 14, which may facilitate assembly of the frac tree 14. In other embodiments, the flapper valve 44 may be placed in a separate housing that couples to the frac head 32, while still reducing the overall height of the frac tree 14.

Figure 2:
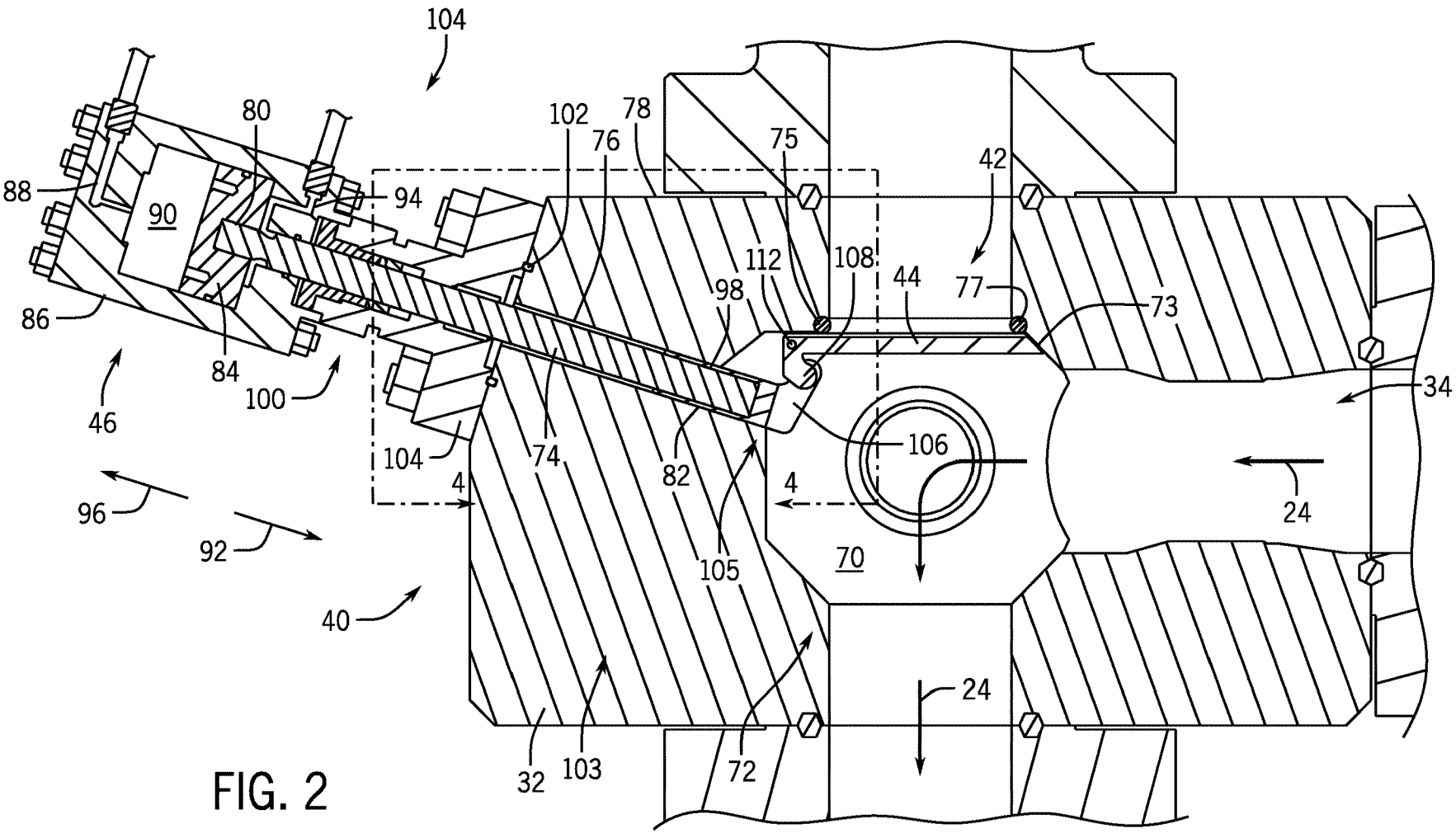
FIG. 2 is a cross-sectional view of an embodiment of a flapper valve system in a closed position.

FIG. 2 is a cross-sectional view of an embodiment of the flapper valve system 40 in a closed position. As explained above, the flapper valve system 40 includes a flapper valve 44 and the actuator 46 that open and closes the flapper valve 44. The flapper valve 44 rests within the cavity 70 that fluidly communicates with the first inlet 34, the second inlet 42, and an outlet 72. In the closed position, the flapper valve 44 directs frac fluid flowing into the cavity 70 through the first inlet 34 and to the outlet 72. By directing frac fluid away from the second inlet 42, the flapper valve 44 may reduce or block contact between the valve 38 and the frac fluid 24 while also providing redundant barrier protection between the cavity 70 and the lubricator 36 and/or the exterior environment. In some embodiments, the pressure of the frac fluid 24 flowing through the cavity 70 facilitates sealing between the flapper valve 44 and the frac head 32 by compressing a portion of the flapper valve 44 against an interior surface 73 that defines the cavity 70. In some embodiments and instead of forming a metal-to-metal seal the flapper valve system 40 may include a seal 75 (e.g., circumferential seal) that rests within a groove 77 (e.g., circumferential groove) about the second inlet 42. When the flapper valve 44 is in the closed position the flapper valve 44 seals against the seal 75. The seal 75 may include rubber, polymers, polytetrafluoroethylene, or combinations thereof.

The flapper valve 44 couples to the actuator 46 with a stem 74 that extends from the actuator 46 into the frac head 32. More specifically, the stem 74 extends into a stem aperture 76 that extends between an exterior surface 78 of the frac head 32 and the cavity 70. The stem 74 defines a first end 80 and a second end 82 with the first end coupling to a piston 84. For example, the stem 74 may threadingly couple to the piston 84. The piston 84 rests within a cylinder 86 of the actuator 46. In operation, pressurized fluid may enter the cylinder 86 on opposite sides of the piston 84 to move the piston 84. As the piston 84 moves, the movement is transmitted through the stem 74 actuating the flapper valve 44 between open and closed positions.

For example, to close the flapper valve 44, pressurized fluid is directed into the cylinder 86 through a conduit 88 creating pressure within a cavity 90 of the cylinder 86. This pressure drives the piston 84 in direction 92 closing the flapper valve 44. To open the flapper valve 44, pressurized fluid is directed into the cylinder 86. However, instead of flowing through the conduit 88, the fluid flows through conduit 94. As pressure builds within the cavity 90, the pressure drives the piston 84 in direction 96 opening the flapper valve 44. The pressurized fluid may be supplied from a variety of pressurized fluid sources including pumps, accumulators, or combinations thereof.

The second end 82 of the stem 74 couples to a seal sleeve 98 which forms a seal with the frac head 32 within the stem aperture 76. In some embodiments, the stem 74 may couple to the seal sleeve 98 by threading into the seal sleeve 98. The seal sleeve 98 forms a seal with the frac head 32 to block frac fluid or other fluids flowing through the cavity 70 from passing through the stem aperture 76. The seal sleeve 98 in combination with a packer 100, and a seal 102 form a seal system 103 that blocks or reduces fluid in the frac head 32 from exiting the frac tree 14. As illustrated, the packer 100 and seal sleeve 98 form a seal about the stem 74, while the seal 102 forms a seal between the bonnet 104 and the exterior surface 78 of the frac head 32. The actuator 46 may include additional seals to control pressurized fluid entering and exiting actuator 46 during operation.

The seal sleeve 98 couples to the flapper valve 44 with a yoke 105. The yoke 105 may be formed with a bow 106 that couples to a beam or hinge 108 of the flapper valve 44. In some embodiments, the bow 106 may integral with or formed out of the same piece (i.e., one-piece) as the seal sleeve 98. The bow 106 and beam/hinge 108 couple together with a pin 110. In order to rotate between open and closed positions, the flapper valve 44 rotates about a pin 112 that couples the flapper valve 44 to the frac head 32. In some embodiments, the flapper valve 44, seal sleeve 98, yoke 105, pin 110, pin 112 may be made out of material capable of operating in a fracing environment. For example, the components may be made out of carbide coated alloy steel, alloy steel high strength alloy, 718 inconel (e.g., flapper), and polytetrafluoroethylene (e.g., seals).

Figure 3:
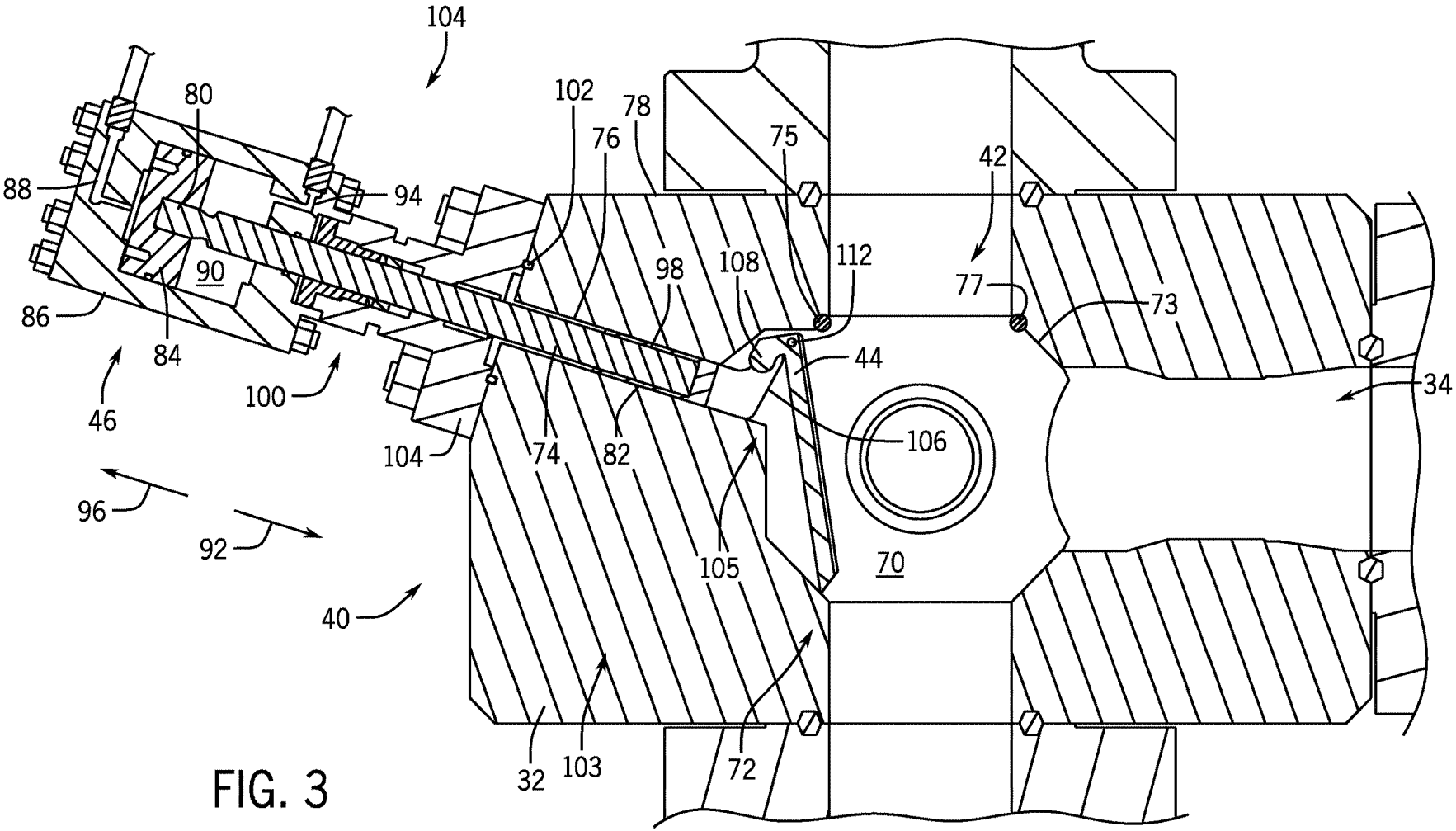
FIG. 3 is a cross-sectional view of an embodiment of a flapper valve system in an open position.

FIG. 3 is a cross-sectional view of an embodiment of the flapper valve system 40 in an open position. In order to open the flapper valve 44, pressurized fluid is directed into the cylinder 86 creating pressure that drives the piston 84 in direction 96. As the piston 84 moves in direction 96 it pulls/retracts the stem 74, which in turn pulls the seal sleeve 98 and the yoke 105. This motion rotates the flapper valve 44 about the pin 112 as the flapper valve 44 transitions from a closed position seen in FIG. 2 to the open position seen in FIG. 3. In the open position, tools may be inserted and/or fluid injected through the second inlet 42, through the frac head 32, and into the well 12.

Figure 4:
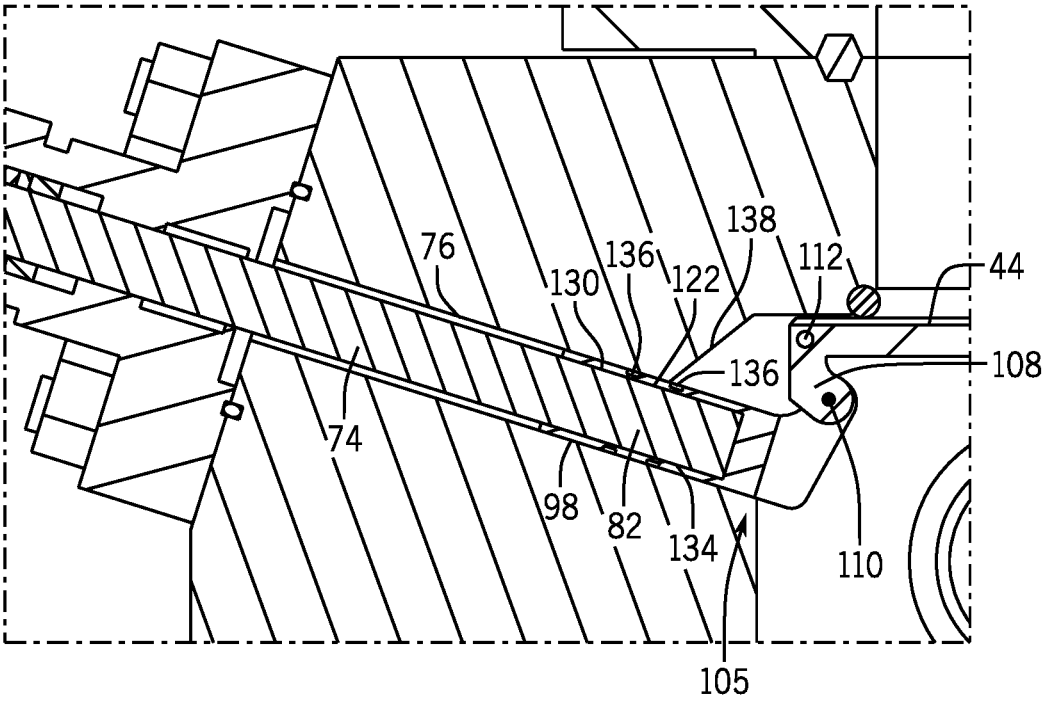
FIG. 4 is a cross-sectional view of an embodiment of the flapper valve system of FIG. 2 within line 4-4.

FIG. 4 is a cross-sectional view of an embodiment of the flapper valve system of FIG. 2 within line 4-4. As illustrated, the seal sleeve 98 includes a blind hole/aperture 130 that receives the second end 82 of the stem 74. For example, the seal sleeve 98 may include threads 132 that threadingly engage corresponding threads 134 on the stem 74. The seal sleeve 98 seals with the frac head 32 with one or more seals 136 that extend about the circumference of the seal sleeve 98. While the seal sleeve 98 includes two seals 136, other embodiments may include 1, 2, 3, 4, 5, or more seals 136 around the seal sleeve 98. To enable rotation of the flapper valve 44 between the open and closed positions, the frac head 32 may include a recess 138 that receives the beam/hinge 108. For example, the recess 138 may enable the flapper valve 44 to rotate 60 or more degrees in order to completely open the second inlet 42. In some embodiments, the recess 138 may be sized to receive only the beam/hinge 108.

Figure 5:
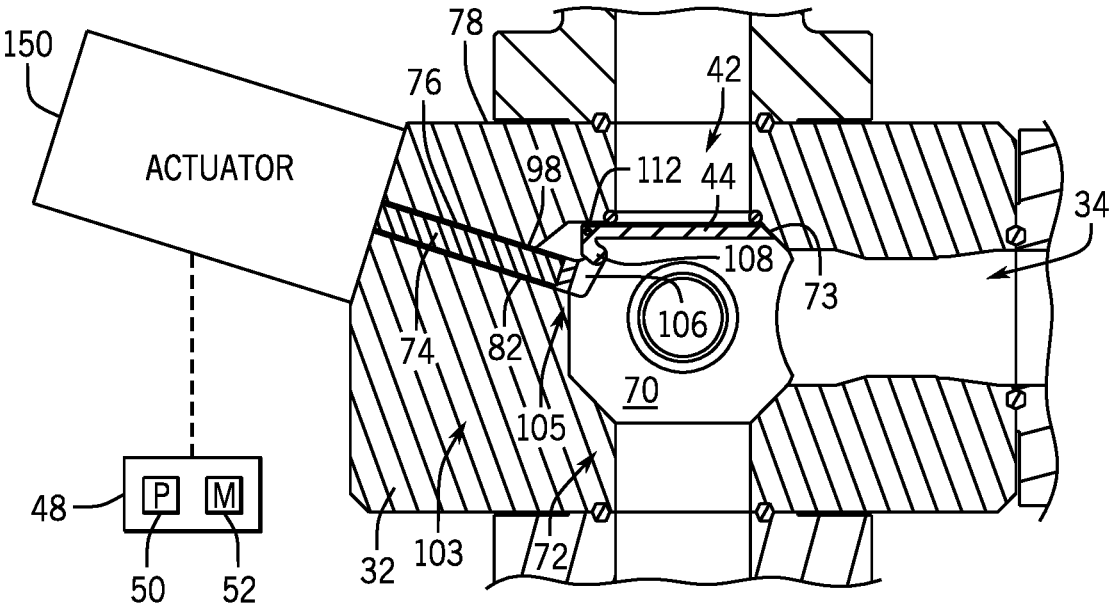
FIG. 5 is a cross-sectional view of an embodiment of a flapper valve system.

FIG. 5 is a cross-sectional view of an embodiment of a flapper valve system 40. In FIGS. 2 and 3 the flapper valve system 40 was described as being actuated with a hydraulic actuator 46. It should be understood that other types of actuators 150 may be used to actuate/drive the flapper valve 44. For example, the actuator 150 coupled to the stem 74 may be an electric actuator, pneumatic actuator, hydraulic actuator, manual actuator, or a combination thereof.

Figure 6:
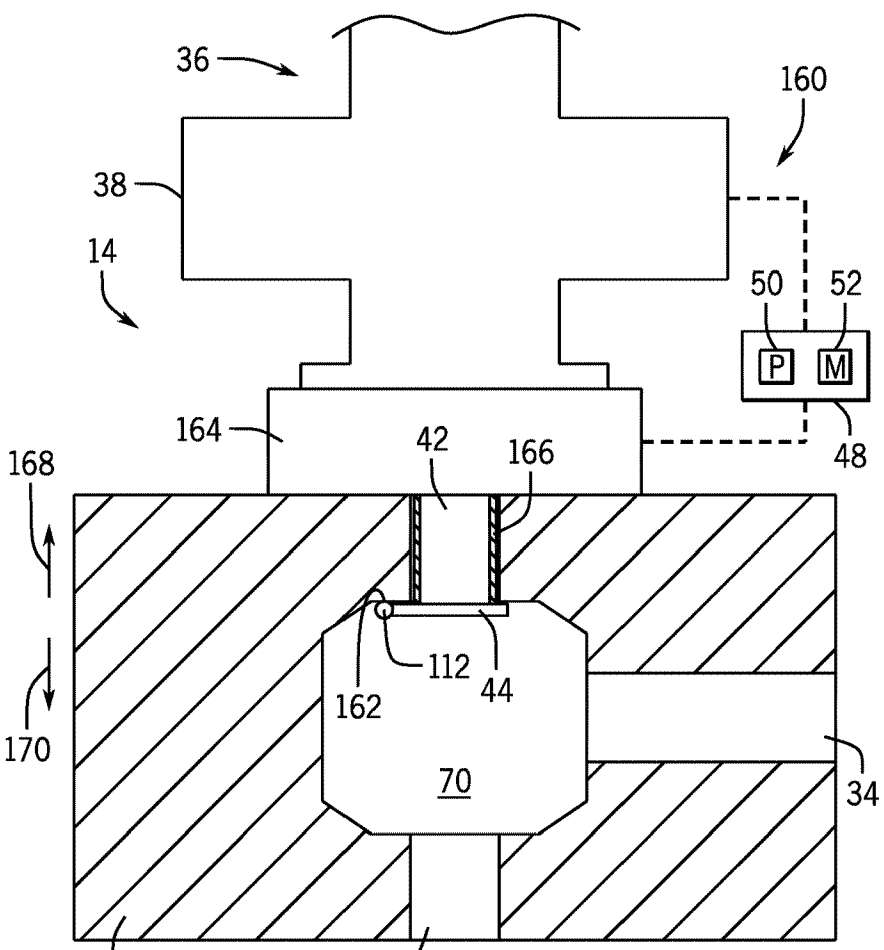
FIG. 6 is a cross-sectional view of an embodiment of a flapper valve system in a closed position.

FIG. 6 is a cross-sectional view of an embodiment of a flapper valve system 160 in a closed position. As explained above, the frac head/housing 32 includes a first inlet 34, second inlet 42, and an outlet 72. The first inlet 34 and outlet 72 enable pressurized frac fluid to flow through the frac tree 14 and into the well 12, while the second inlet 42 and outlet 72 enables tools (e.g., logging tools, perforating guns) to pass through the frac head 32 and into the well 12. In order to block the flow of frac fluid through the second inlet 42 and into the lubricator 36 while fracing the well 12, the frac tree 14 includes the valve 38 and the flapper valve system 160. In some embodiments, the valve 38 may be a gate valve. The combination of the valve 38 and the flapper valve system 160 provide a dual barrier that blocks the flow of fluid through the second inlet 42. By including a flapper valve system 160 instead of another gate valve stacked on top of the frac head or housing 32, the overall height of the frac tree 14 may be reduced thus facilitating assembly of the frac tree 14.

In some embodiments, the flapper valve 44 may be biased to a close position. For example, a spring 162 may bias the flapper valve 44 to the closed position. In order to open the flapper valve 44, the flapper valve system 160 includes an actuator 164 that drives movement of a piston 166 in directions 168 and 170. The actuator 164 may be an electric actuator, pneumatic actuator, hydraulic actuator, manual actuator, or a combination thereof. In operation the actuator 164 retracts the piston 166 in direction 168 and extends the piston 166 in direction 170. The extension and retraction of the piston 166 opens and closes the flapper valve 44 enabling tools to extend through the piston 166 and the second inlet 42. As illustrated in FIG. 6, the piston 166 is in a retracted position that enables the spring 162 to bias the flapper valve 44 against the interior surface 73 of the frac head 32 into a closed position. In the closed position, the force of the spring 162 and/or the pressure of the frac fluid flowing through the cavity 70 enables the flapper valve 44 to form a seal with the frac head 32.

Figure 7:
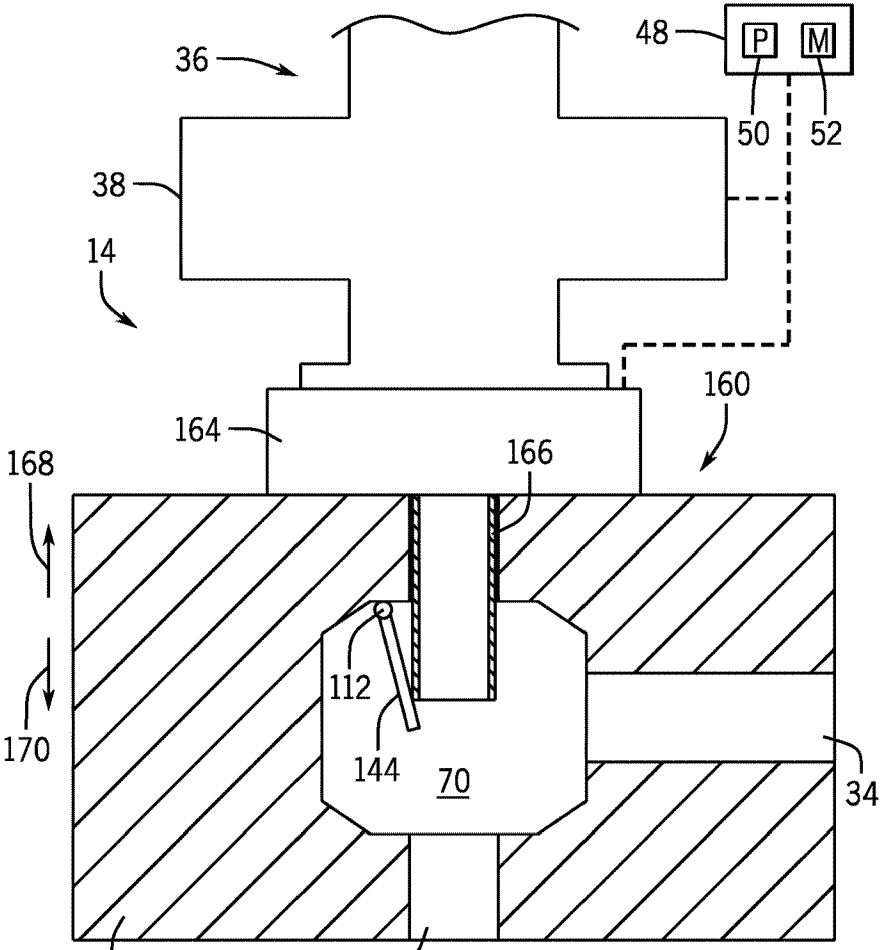
FIG. 7 is a cross-sectional view of an embodiment of a flapper valve system in an open position.

In order to open the flapper valve 44, the actuator 164 drives the piston 166 in direction 170 and into contact with the flapper valve 44, as seen in FIG. 7. The contact between the piston 166 and the flapper valve 44 overcomes the force of the spring 162 and enables the flapper valve 44 to rotate about the pin 112 into an open position. In the open position, tools and or fluid may move through the second inlet 42 and the piston 166 and into the well 12. The piston may 166 may remain in this extended position until the tool is retracted out of the well 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A frac system, comprising:

a frac head, the frac head defining a first inlet, a second inlet, and an outlet, wherein the frac head is configured to receive frac fluid through the first inlet and direct the frac fluid to the outlet fluidly coupled to a wellhead;

a flapper valve within the frac head, wherein the flapper valve is configured to move between an open position and a closed position to control fluid flow through the second inlet; and a seal sleeve disposed about a stem in a stem aperture in the frac head, wherein the stem is configured to move the flapper valve between the open position and the closed position.

2. The system of claim 1, comprising a valve coupled to the second inlet of the frac head and a lubricator coupled to the valve, wherein the flapper valve is configured to control a fluid flow to the valve through the second inlet.

3. The system of claim 2, wherein the valve is a gate valve.

4. The system of claim 1, wherein the flapper valve couples to the frac head with a connector, the flapper valve is configured to rotate about the connector between the open and closed positions in response to movement of a yoke in a crosswise direction relative to a central axis of the second inlet.

5. The system of claim 1, comprising an actuator system configured to open and close the flapper valve, wherein the actuator system comprises an actuator configured to move the flapper valve between the open position and the closed position, wherein an actuation axis of the actuator is oriented at an acute angle relative to a central axis of the second inlet.

6. The system of claim 1, comprising a seal within a circumferential groove about the second inlet.

7. The system of claim 1, where in the stem extends crosswise to a central axis of the second inlet, and the stem is configured to move axially within the stem aperture to move the flapper valve between the open position and the closed position.

8. The system of claim 1, wherein the frac head defines a recess, the recess is configured to enable a hinge of the flapper valve to rotate inwardly into the recess in the open position of the flapper valve and outward from the recess in the closed position of the flapper valve.

9. A system comprising:

a frac head, the frac head defining a stem aperture, a first inlet, a second inlet, and an outlet, wherein the frac head is configured to receive frac fluid through the first inlet and direct the frac fluid to the outlet fluidly coupled to a wellhead;

a flapper valve within the frac head, wherein the flapper valve is configured to move between an open position and a closed position to open and close the second inlet to control fluid flow to a valve;

an actuator coupled to the frac head and configured to actuate the flapper valve; and a stem disposed in the stem aperture extending crosswise to a central axis of the second inlet, wherein the stem is configured to couple the flapper valve to the actuator, and the stem is configured to move axially within the stem aperture to open and close the flapper valve.

10. The system of claim 9, wherein the actuator comprises an electric actuator, a pneumatic actuator, a hydraulic actuator, or a combination thereof.

11. The system of claim 9, comprising a seal sleeve within the frac head, wherein the seal sleeve is configured to form a seal in the stem aperture of the frac head.

12. The system of claim 9, wherein the stem disposed in the stem aperture extends at an acute angle relative to the central axis of the second inlet.

13. The system of claim 9, wherein the stem is configured to move axially along a first axis within the stem aperture, the flapper valve is configured to rotate about a second axis between open and closed positions, and the second axis is offset and crosswise relative to the first axis.

14. The system of claim 9, comprising the valve and a lubricator coupled to the valve.

15. The system of claim 9, comprising a seal within a circumferential groove about the second inlet.

16. A frac system, comprising:

a flapper valve system;

a frac head, the frac head defining a stem aperture, a first inlet, a second inlet, and an outlet, wherein the frac head is configured to receive frac fluid through the first inlet and direct the frac fluid to the outlet fluidly coupled to a wellhead;

a flapper valve within the frac head, wherein the flapper valve is configured to move between an open position and a closed position to control fluid flow through the second inlet; and a stem extending along a first axis of the stem aperture and coupling with the flapper valve, wherein the first axis of the stem is oriented at an acute angle relative to a central axis of the second inlet, and the stem is configured to move the flapper valve between the open position and the closed position.

17. The frac system of claim 16, comprising:

a valve coupled to the frac head, wherein the flapper valve is configured to control a flow of fluid to the valve;

a lubricator coupled to the valve; and an actuator coupled to the stem.

18. The frac system of claim 16, wherein the flapper valve is configured to rotate about a second axis between the open position and the closed position, and the second axis is offset and crosswise relative to the first axis.

* * * * *